US008930183B2

(12) United States Patent
Chun et al.

(10) Patent No.: US 8,930,183 B2
(45) Date of Patent: Jan. 6, 2015

(54) VOICE CONVERSION METHOD AND SYSTEM

(75) Inventors: Byung Ha Chun, Cambridge (GB); Mark John Francis Gales, Cambridge (GB)

(73) Assignee: Kabushiki Kaisha Toshiba, Tokyo (JP)

( * ) Notice: Subject to any disclaimer, the term of this patent is extended or adjusted under 35 U.S.C. 154(b) by 445 days.

(21) Appl. No.: 13/217,628

(22) Filed: Aug. 25, 2011

(65) Prior Publication Data

US 2012/0253794 A1 Oct. 4, 2012

(30) Foreign Application Priority Data

Mar. 29, 2011 (GB) ..... 1105314.7

(51) Int. Cl.

| | |
|---|---|
| ***G10L 19/00*** | (2013.01) |
| ***G10L 21/00*** | (2013.01) |
| ***G10L 21/003*** | (2013.01) |
| ***G10L 21/007*** | (2013.01) |
| *G10L 21/013* | (2013.01) |
| *G10L 13/033* | (2013.01) |

(52) U.S. Cl.

CPC ..... *G10L 21/003* (2013.01); *G10L 21/007* (2013.01); *G10L 2021/0135* (2013.01); *G10L 13/033* (2013.01)

USPC ..... 704/201; 704/200; 704/202; 704/203; 704/205; 704/208; 704/214; 704/256

(58) Field of Classification Search

None

See application file for complete search history.

(56) References Cited

U.S. PATENT DOCUMENTS

| | | | | |
|---|---|---|---|---|
| 5,704,006 | A | 12/1997 | Iwahashi | |
| 6,374,216 | B1 | 4/2002 | Micchelli et al. | |
| 7,412,377 | B2 * | 8/2008 | Monkowski | 704/206 |
| 7,505,950 | B2 * | 3/2009 | Tian et al. | 706/45 |
| 7,590,532 | B2 * | 9/2009 | Suzuki et al. | 704/230 |
| 7,702,503 | B2 * | 4/2010 | Monkowski | 704/206 |
| 8,060,565 | B1 * | 11/2011 | Swartz | 709/206 |

(Continued)

FOREIGN PATENT DOCUMENTS

CN 101751921 6/2010

OTHER PUBLICATIONS

Miyamoto et al., (Miyamoto, D.; Nakamura, K.; Toda, T.; Saruwatari, H.; Shikano, K., "Acoustic compensation methods for body transmitted speech conversion," Acoustics.*

(Continued)

*Primary Examiner* — Richemond Dorvil
*Assistant Examiner* — Thuykhanh Le
(74) *Attorney, Agent, or Firm* — Oblon, Spivak, McClelland, Maier & Neustadt, L.L.P.

(57) ABSTRACT

A method of converting speech from the characteristics of a first voice to the characteristics of a second voice, the method comprising:

receiving a speech input from a first voice, dividing said speech input into a plurality of frames;

mapping the speech from the first voice to a second voice; and outputting the speech in the second voice, wherein mapping the speech from the first voice to the second voice comprises, deriving kernels demonstrating the similarity between speech features derived from the frames of the speech input from the first voice and stored frames of training data for said first voice, the training data corresponding to different text to that of the speech input and wherein the mapping step uses a plurality of kernels derived for each frame of input speech with a plurality of stored frames of training data of the first voice.

16 Claims, 7 Drawing Sheets

(56) References Cited

U.S. PATENT DOCUMENTS

| | | | | |
|---|---|---|---|---|
| 2005/0131680 | A1* | 6/2005 | Chazan et al. | 704/205 |
| 2008/0082320 | A1* | 4/2008 | Popa et al. | 704/201 |
| 2008/0111887 | A1* | 5/2008 | Cooper et al. | 348/194 |
| 2008/0201150 | A1* | 8/2008 | Tamura et al. | 704/266 |
| 2008/0262838 | A1 | 10/2008 | Nurminen et al. | |
| 2009/0089063 | A1* | 4/2009 | Meng et al. | 704/270 |
| 2009/0094027 | A1* | 4/2009 | Nurminen et al. | 704/235 |
| 2010/0049522 | A1* | 2/2010 | Tamura et al. | 704/264 |
| 2010/0088089 | A1* | 4/2010 | Hardwick | 704/208 |
| 2010/0094620 | A1* | 4/2010 | Hardwick | 704/208 |
| 2011/0125493 | A1* | 5/2011 | Hirose et al. | 704/207 |
| 2011/0218804 | A1* | 9/2011 | Chun | 704/243 |
| 2012/0095762 | A1* | 4/2012 | Eom et al. | 704/237 |

OTHER PUBLICATIONS

Chapters 2 and 4 Covariance Functions C. E. Rasmussen & C. K. I. Williams, Gaussian Processes for Machine Learning, the MIT Press, 2006, ISBN 026218253X. c 2006 Massachusetts Institute of Technology. www.GaussianProcess.org/gpml).*

Stylianou, Y.; Cappe, O., "A system for voice conversion based on probabilistic classification and a harmonic plus noise model", Acoustics, Speech and Signal Processing, 1998. Proceedings of the 1998 IEEE International Conference on, vol. 1, no., pp. 281, 284 vol. 1, May 12-15, 1998).*

Mouchtaris, A.; Agiomyrgiannakis, Y.; Stylianou, Y., "Conditional Vector Quantization for Voice Conversion," Acoustics, Speech and Signal Processing, 2007. ICASSP 2007. IEEE International Conference on, vol. 4, no., pp. IV-505, IV-508, Apr. 15-20, 2007.*

Baneriee et al., "Model-based Overlapping Clustering" , Proceedings of the Eleventh ACM SIGKDD International Conference on Knowledge Discovery and Data Mining Chicago, IL, pp. 532-537, Aug. 2005.*

United Kingdom Search Report Issued Jul. 28, 2011, in Great Britain Patent Application No. 1105314.7, filed Mar. 29, 2011.

Tomoki Toda, et al., "Voice Conversion Based on Maximum-Likelihood Estimation of Spectral Parameter Trajectory," IEEE Transactions on Audio, Speech and Language Processing, vol. 15, No. 8, Nov. 2007, pp. 2222-2235.

Masatsune Tamura, et al., "Speaker adaptation for HMM-based speech synthesis system using MLLR," Proceedings of the 3rd ESCA/COCOSDA International Workshop on Speech Synthesis, 1998, pp. 273-276.

Christopher K. I. Williams, et al., "Gaussian Processes for Regression," Advances in Neural Information Processing Systems 8, 1996, pp. 514-520.

* cited by examiner

VOICE CONVERSION METHOD AND SYSTEM

CROSS REFERENCE TO RELATED APPLICATIONS

This application is based upon and claims the benefit of priority from United Kingdom Patent Application No. 1105314.7, filed Mar. 29, 2011; the entire contents of which are incorporated herein by reference.

FIELD

Embodiments of the present invention described herein generally relate to voice conversion.

BACKGROUND

Voice Conversion (VC) is a technique for allowing the speaker characteristics of speech to be altered. Non-linguistic information, such as the voice characteristics, is modified while keeping the linguistic information unchanged. Voice conversion can be used for speaker conversion in which the voice of a certain speaker (source speaker) is converted to sound like that of another speaker (target speaker).

The standard approaches to VC employ a statistical feature mapping process. This mapping function is trained in advance using a small amount of training data consisting of utterance pairs of source and target voices. The resulting mapping function is then required to be able to convert of any sample of the source speech into that of the target without any linguistic information such as phoneme transcription.

The normal approach to VC is to train a parametric model such as a Gaussian Mixture Model on the joint probability density of source and target spectra and derive the conditional probability density given source spectra to be converted.

BRIEF DESCRIPTION OF THE DRAWINGS

The present invention will now be described with reference to the following non-limiting embodiments.

DETAILED DESCRIPTION

Figure 1:
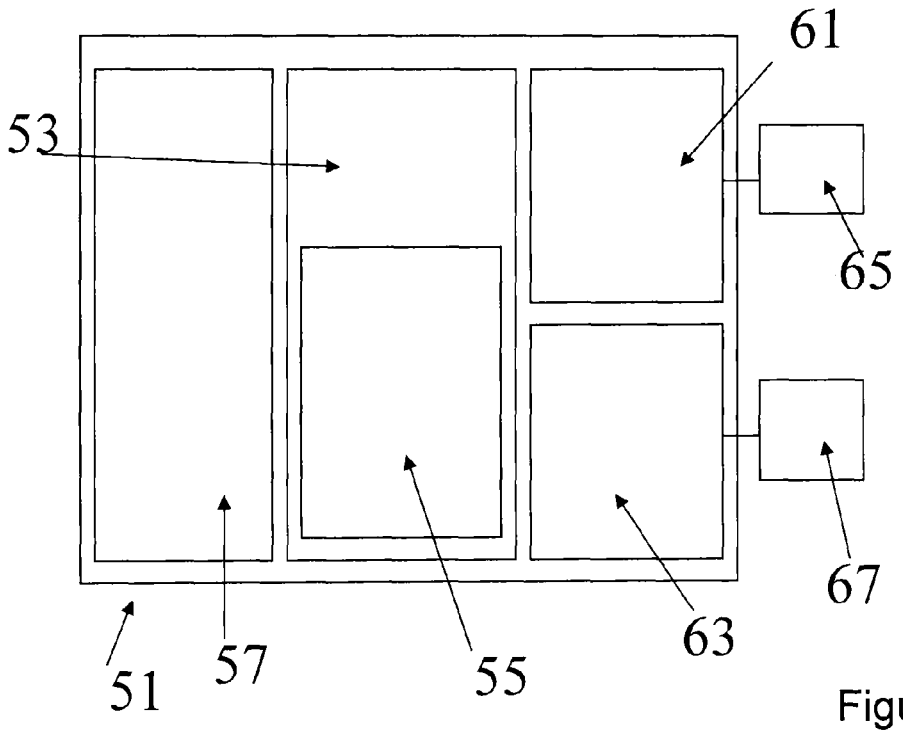
FIG. 1 is a schematic of a voice conversion system in accordance with an embodiment of the present invention.

In an embodiment, the present invention provides a method of converting speech from the characteristics of a first voice to the characteristics of a second voice, the method comprising:

receiving a speech input from a first voice, dividing said speech input into a plurality of frames;

mapping the speech from the first voice to a second voice; and outputting the speech in the second voice, wherein mapping the speech from the first voice to the second voice comprises, deriving kernels demonstrating the similarity between speech features derived from the frames of the speech input from the first voice and stored frames of training data for said first voice, the training data corresponding to different text to that of the speech input and wherein the mapping step uses a plurality of kernels derived for each frame of input speech with a plurality of stored frames of training data of the first voice.

The kernels can be derived for either static features on their own or static and dynamic features. Dynamic features take into account the preceding and following frames.

In one embodiment, the speech to be output is determined according to a Gaussian Process predictive distribution:

$$p(y_t|x_t,x^*,y^*,\mathcal{M})=\mathcal{N}(\mu(x_t),\Sigma(x_t)),$$

where $y_t$ is the speech vector for frame t to be output, $x_t$ is the speech vector for the input speech for frame t, x*, y* is $\{x_1^*, y_1^*\}, \ldots, \{x_N^*, y_N^*\}$, where xt* is the $t^{th}$ frame of training data for the first voice and yt* is the $t^{th}$ frame of training data for the second voice, M denotes the model, $\mu(x_t)$ and $\Sigma(x_t)$ are the mean and variance of the predictive distribution for given $x_t$.

Further:

$$\mu(x_t)=m(x_t)+k_t^T[K^*+\sigma^2 I]^{-1}(y^*-\mu^*),$$

$$\sum(x_t)=k(x_t,x_t)+\sigma^2-k_t^T[K^*+\sigma^2 I]^{-1}k_t,$$

where $$\mu^*=[m(x_1^*)\ m(x_2^*)\ \ldots\ m(x_N^*)]^T$$

$$K^*=\begin{bmatrix} k(x_1^*,x_1^*) & k(x_1^*,x_2^*) & \ldots & k(x_1^*,x_N^*) \\ k(x_2^*,x_1^*) & k(x_2^*,x_2^*) & \ldots & k(x_2^*,x_N^*) \\ \vdots & \vdots & \ldots & \vdots \\ k(x_N^*,x_1^*) & k(x_N^*,x_2^*) & \ldots & k(x_N^*,x_N^*) \end{bmatrix}$$

$$k_t=[k(x_1^*,x_t)\ k(x_2^*,x_t)\ \ldots\ k(x_N^*,x_t)]^T$$

and $\sigma$ is a parameter to be trained, $m(x_1)$ is a mean function and k(a,b) is a kernel function representing the similarity between a and b.

The kernel function may be isotropic or non-stationery. The kernel may contain a hyper-parameter or be parameter free.

In an embodiment, the mean function is of the form: $m(x)=ax+\mu$.

In a further embodiment, the speech features are represented by vectors in an acoustic space and said acoustic space is partitioned for the training data such that a cluster of training data represents each part of the partitioned acoustic space, wherein during mapping a frame of input speech is compared with the stored frames of training data for the first voice which have been assigned to the same cluster as the frame of input speech.

In an embodiment, two types of clusters are used, hard clusters and soft clusters. In the hard clusters the boundary between adjacent clusters is hard so that there is no overlap between clusters. The soft clusters extend slightly beyond the boundary of the hard clusters so that there is overlap between the soft clusters. During mapping, the hard clusters will be used for assignment of a vector representing input speech to a cluster. However, the Gramians K* and/or $k_t$ may be determined over the soft clusters.

The method may operate using pre-stored training data or it may gather the training data prior to use. The training data is used to train hyper-parameters. If the acoustic space has been partitioned, in an embodiment, the hyper-parameters are trained over soft clusters.

Systems and methods in accordance with embodiments of the present invention can be applied to many uses. For example, they may be used to convert a natural input voice or a synthetic voice input. The synthetic voice input may be speech which is from a speech to speech language converter, a satellite navigation system or the like.

In a further embodiment, systems in accordance with embodiments of the present invention can be used as part of an implant to allow a patient to regain their old voice after vocal surgery.

The above described embodiments apply a Gaussian process (GP) to Voice Conversion. Gaussian processes are non-parametric Bayesian models that can be thought of as a distribution over functions. They provide advantages over the conventional parametric approaches, such as flexibility due to their non-parametric nature.

Further, such a Gaussian Process based approach is resistant to over-fitting.

As such an approach is non-parametric it tackles the issue of the meaning of parameters used in a parametric approach. Also, being non-parametric means that there are only a few hyper-parameters that need to be trained and these parameters maintain their meaning even when more data is introduced. These advantages help to circumvent issues with scaling.

In accordance with further embodiments, a system is provided for converting speech from the characteristics of a first voice to the characteristics of a second voice, the system comprising:

a receiver for receiving a speech input from a first voice;

a processor configured to:

divide said speech input into a plurality of frames; and map the speech from the first voice to a second voice, the system further comprising an output to output the speech in the second voice, wherein to map the speech from the first voice to the second voice, the processor is further adapted to derive kernels demonstrating the similarity between speech features derived from the frames of the speech input from the first voice and stored frames of training data for said first voice, the training data corresponding to different text to that of the speech input, the processor using a plurality of kernels derived for each frame of input speech with a plurality of stored frames of training data of the first voice.

Methods and systems in accordance with embodiments can be implemented either in hardware or on software in a general purpose computer. Further embodiments can be implemented in a combination of hardware and software. Embodiments may also be implemented by a single processing apparatus or a distributed network of processing apparatuses.

Since methods and systems in accordance with embodiments can be implemented by software, systems and methods in accordance with embodiments may be implanted using computer code provided to a general purpose computer on any suitable carrier medium. The carrier medium can comprise any storage medium such as a floppy disk, a CD ROM, a magnetic device or a programmable memory device, or any transient medium such as any signal e.g. an electrical, optical or microwave signal.

FIG. 1 is a schematic of a system which may be used for voice conversion in accordance with an embodiment of the present invention.

FIG. 1 is schematic of a voice conversion system which may be used in accordance with an embodiment of the present invention. The system 51 comprises a processor 53 which runs voice conversion application 55. The system is also provided with memory 57 which communicates with the application as directed by the processor 53. There is also provided a voice input module 61 and a voice output module 63. Voice input module 61 receives a speech input from speech input 65. Speech input 65 may be a microphone or maybe received from a storage medium, streamed online etc. The voice input module 61 then communicates the input data to the processor 53 running application 55. Application 55 outputs data corresponding to the text of the speech input via module 61 but in a voice different to that used to input the speech. The speech will be output in the voice of a target speaker which the user may select through application 55. This data is then put in output to voice output module 63 which converts the data into a form to be output by voice output 67. Voice output 67 may be a direct voice output such as a speaker or maybe the output for a speech file to be directed towards a storage medium, streamed over the Internet or directed towards a further program as required.

The above voice combination system converts speech from one speaker, (an input speaker) into speech from a different speaker (the target speaker). Ideally, the actual words spoken by the input speaker should be identical to those spoken by the target speaker. The speech of the input speaker is matched to the speech of the output speaker using a mapping function. In embodiments of the present invention, the mapping operation is derived using Gaussian Processes. This is essentially a non-parametric approach to the mapping operation.

To explain how the mapping operation is derived using Gaussian Processes, it is first useful to understand how the mapping function is derived for a parametric Gaussian Mixture Model. Conditionals and marginals of Gaussian distributions are themselves Gaussian. Namely if $$p(x_1, x_2) = N\left(\begin{bmatrix} x_1 \\ x_2 \end{bmatrix}; \begin{bmatrix} \mu_1 \\ \mu_2 \end{bmatrix}, \begin{bmatrix} \sum_{11} & \sum_{12} \\ \sum_{21} & \sum_{22} \end{bmatrix}\right),$$

then $$p(x_1) = N(x_1; \mu_1, \textstyle\sum_{11}),$$

-continued $$p(x_2) = N(x_2; \mu_1, \textstyle\sum_{22}),$$

$$p(x_1 \mid x_2) = N\left(x_1; \mu_1 + \textstyle\sum_{12}\sum_{22}^{-1}(x_2 - \mu_2), \sum_{11} - \sum_{12}\sum_{22}^{-1}\sum_{21}^{T}\right),$$

$$p(x_2 \mid x_1) = N\left(x_2; \mu_2 + \textstyle\sum_{21}\sum_{11}^{-1}(x_1 - \mu_1), \sum_{22} - \sum_{21}\sum_{11}^{-1}\sum_{12}^{T}\right).$$

Let $x_t$ and $y_t$ be spectral features at frame t for source and target voices, respectively. (For notation simplicity, it is assumed that $x_t$ and $y_t$ are scalar values. Extending them to vectors is straightforward.) GMM-based voice conversion. approaches typically model the joint probability density of the source and target spectral features by a GMM as $$p(z_t \mid \lambda^{(z)}) = \sum_{m=1}^{M} w_m \, N\left(z_t; \mu_m^{(z)}, \textstyle\sum_m^{(z)}\right), \tag{1}$$

where $z_t$ is a joint vector $[x_t, y_t]^T$, m is the mixture component index, M is the total number of mixture components, $\omega_n$, is the weight of the m-th mixture component. The mean vector and covariance matrix of the m-th component, $\mu_m^{(z)}$ and $\Sigma_m^{(z)}$ are given as $$\mu_m^{(z)} = \begin{bmatrix} \mu_m^{(x)} \\ \mu_m^{(y)} \end{bmatrix} \quad \sum_m^{(z)} = \begin{bmatrix} \sum_m^{(xx)} & \sum_m^{(xy)} \\ \sum_m^{(yx)} & \sum_m^{(yy)} \end{bmatrix}. \tag{2}$$

A parameter set of the GMM is $\lambda^{(z)}$, which consists of weights, mean vectors, and the covariance matrices for individual mixture components.

The parameters set $\lambda^{(z)}$ is estimated from supervised training data, $\{x_1^*, y_1^*\}, \ldots, \{x_N^*, y_N^*\}$, which is expressed as $x^*$, $y^*$ for the source and targets, based on the maximum likelihood (ML) criterion as $$\hat{\lambda}^{(z)} = \arg\max_{\lambda^{(z)}} p(z^* \mid \lambda^{(z)}), \tag{3}$$

where $z^*$ is the set of training joint vectors $z=\{z_1^*, \ldots z_N^*\}$ and $z_t^*$ is the training joint vector at frame t, $z_t^*=[x_t^*, y_t^*]^T$.

In order to derive the mapping function, the conditional probability density of $y_t$, given $x_t$, is derived from the estimated GMM as follows:

$$p(y_t \mid x_t, \hat{\lambda}^{(z)}) = \sum_{m=1}^{M} P(m \mid x_t, \hat{\lambda}^{(z)}) p(y_t \mid x_t, m, \hat{\lambda}^{(z)}). \tag{4}$$

The conventional approach, the conversion may be performed on the basis of the minimum mean-square error (MMSE) as follows:

$$\hat{y}_t = \mathbb{E}[y_t \mid x_t] \tag{5}$$

$$= \int p(y_t \mid x_t, \hat{\lambda}^{(z)}) y_t \, dy_t \tag{6}$$

-continued $$= \int \sum_{m=1}^{M} p(m \mid x_t, \hat{\lambda}^{(z)}) p(y_t \mid x_t, m, \hat{\lambda}^{(z)}) y_t \, dy_t \tag{7}$$

$$= \sum_{m=1}^{M} p(m \mid x_t, \hat{\lambda}^{(z)}) \mathbb{E}[y_t \mid x_t, m], \tag{8}$$

where $$\mathbb{E}[y_t \mid x_t, m] = \mu_m^{(y)} + \textstyle\sum_m^{(yx)} \sum_m^{(xx)^{-1}} (x_t - \mu_m^{(x)}). \tag{9}$$

In order to avoid each frame being independently mapped, it is possible to consider the dynamic features of the parameter trajectory. Here both the static and dynamic parameters are converted, yielding a set of Gaussian experts to estimate each dimension. Thus $$z_t = [x_t, y_t, \Delta x_t, \Delta y_t]^T, \tag{10}$$

$$\Delta x_t = \tfrac{1}{2}(x_{t+1} - x_{t-1}), \tag{11}$$

and similarly for $\Delta y_t$. Using this modified joint model, a GMM is trained with the following parameters for each component m:

$$\mu_m^{(z)} = [\mu_m^{(x)} \; \mu_m^{(y)} \; \mu_m^{(\Delta x)} \; \mu_m^{(\Delta y)}]^T \tag{12}$$

$$\sum_m^{(z)} = \begin{bmatrix} \sum_m^{(xx)} & \sum_m^{(xy)} & 0 & 0 \\ \sum_m^{(yx)} & \sum_m^{(yy)} & 0 & 0 \\ 0 & 0 & \sum_m^{(\Delta x \Delta x)} & \sum_m^{(\Delta x \Delta y)} \\ 0 & 0 & \sum_m^{(\Delta y \Delta x)} & \sum_m^{(\Delta y \Delta y)} \end{bmatrix}. \tag{13}$$

Note to limit the number of parameters in the covariance matrix of z the static and delta parameters are assumed to be conditionally independent given the component. The same process as for the static parameters alone can be used to derive the model parameters. When applying voice conversion to a particular source sequence, this will yield two experts (assuming just delta parameters are added):

$$\text{static expert: } p(y_t \mid x_t, \hat{m}_t, \hat{\lambda}^{(z)}) \tag{14}$$

$$\text{dynamic expert: } p(\Delta y_t \mid \Delta x_t, \hat{m}_t, \hat{\lambda}^{(z)})$$

where[2]

$$\hat{m}_t = \arg\max_m \{P(m \mid x_t, \Delta x_t, \hat{\lambda}^{(z)})\}.$$

As in standard Hidden Markov Model (HMM)-based speech synthesis the sequence $\hat{y}=\{\hat{y}_1 \ldots \hat{y}_N\}$ that maximises the output probability given both experts is produced:

$$\hat{y} = \arg\max_y \left\{ \prod_{t=1}^{T} p(y_t \mid x_t, \hat{m}_t, \hat{\lambda}^{(z)}) p(\Delta y_t \mid \Delta x_t, \hat{m}_t, \hat{\lambda}^{(z)}) \right\}, \tag{15}$$

noting that $$\Delta y_t = \frac{1}{2}(y_{t+1} - y_{t-1}). \tag{16}$$

In a method and system according to an embodiment of the present invention, the mapping function is derived using non parametric techniques such as Gaussian Processes. Gaussian processes (GPs) are flexible models that fit well within a probabilistic Bayesian modelling framework. A GP can be used as a prior probability distribution over functions in Bayesian inference. Given any set of N points in the desired domain of functions, a multivariate Gaussian whose covariance matrix parameter is the Gramian matrix of the N points with some desired kernel, and sample from that Gaussian. Inference of continuous values with a GP prior is known as GP regression. Thus GPs are also useful as a powerful non-linear interpolation tool. Gaussian processes are an extension of multivariate Gaussian distributions to infinite numbers of variables.

The underlying model for a number of prediction models is that (again considering a single dimension)

$$y_t = f(x_t;\lambda)+\epsilon, \tag{17}$$

where epsilon is some Gaussian noise term and $\lambda$ are the parameters that define the model.

Figure 2:
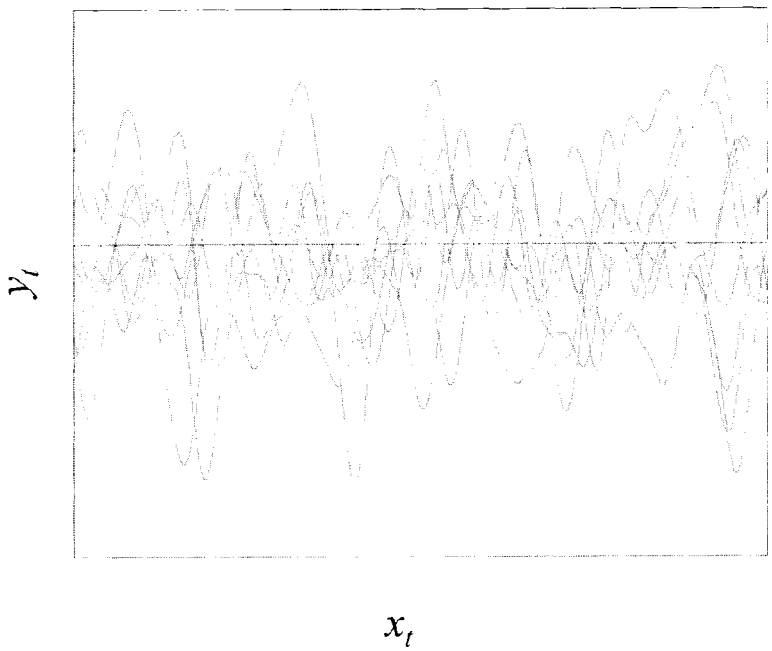
FIG. 2 is a plot of a number of samples drawn from a Gaussian process prior with a gamma exponential kernel with $s^{-1}=2.0$ and $\sigma=2.0$.

A Gaussian Process Prior can be thought of to represent a distribution over functions. FIG. 2 shows a number of samples drawn from a Gaussian process prior with a Gamma-Exponential kernel with s−1=2.0 and σ=2.0.

The above Bayesian likelihood function (17) as before is used with a Gaussian process prior for f(x; ω):

$$f(x;\lambda) \sim \mathcal{GP}(m(x), k(x,x')), \tag{18}$$

where k(x, x') is a kernel function, which defines the "similarity" between x and x', and m(x) is the mean function. Many different types of kernels can be used. For example: covLIN—Linear covariance function:

$$k(x_p,x_q)=x_p^T x_q \tag{K1}$$

covLINard—Linear covariance function with Automatic Relevance Determination, where P is a hyper parameter to be trained.

$$k(x_p,x_q)=x_p^T P^{-1} x_q \tag{K2}$$

covLINOne—Linear covariance function with a bias. Where $t_2$ is a hyper parameter to be trained $$k(x_p, x_q) = \frac{x_p^T x_q + 1}{t_2} \tag{K3}$$

covMaterniso—Matern covariance function with v=d/2, $r=\sqrt{(x_p-x_q)^T P^{-1}(x_p-x_q)}$ and isotropic distance measure.

$$k(x_p,x_q)=\sigma_f^2 * f(\sqrt{d}*r)*\exp(-\sqrt{d}*r) \tag{K4}$$

covNNone—Neural network covariance function with a single parameter for the distance measure. Where $\sigma_f$ is a hyperparameter to be trained.

$$k(x_p, x_q) = \sigma_f^2 \arcsin \frac{x_p^T P x_q}{\sqrt{(1 + x_p^T P x_p)\cdot(1 + x_q^T P x_q)}} \tag{K5}$$

covPoly—Polynomial covariance function. Where c is a hyper-parameter to be trained $$k(x_p,x_q)=\sigma_f^2 (c+x_p^T x_q)^d \tag{K6}$$

covPPiso—Piecewise polynomial covariance function with compact support $$k(x_p,x_q)=\sigma_f^2 * (1-r)+^j * f(r,j)$$

covRQard—Rational Quadratic covariance function with Automatic Relevance Determination where α is a hyperparameter to be trained.

$$k(x_p, x_q) = \sigma_f^2 \left\{1 + \frac{(x_p - x_q)^T P^{-1}(x_p - x_q)}{2\alpha}\right\}^{-\alpha} \tag{K7}$$

covRQiso—Rational Quadratic covariance function with isotropic distance measure $$k(x_p, x_q) = \sigma_f^2 \left\{1 + \frac{(x_p - x_q)^T P^{-1}(x_p - x_q)}{2\alpha}\right\}^{-\alpha} \tag{K8}$$

covSEard—Squared Exponential covariance function with Automatic Relevance Determination $$k(x_p, x_q) = \sigma_f^2 \exp\left\{\frac{-(x_p - x_q)^T P^{-1}(x_p - x_q)}{2}\right\} \tag{K9}$$

covSEiso—Squared Exponential covariance function with isotropic distance measure.

$$k(x_p, x_q) = \sigma_f^2 \exp\left\{\frac{-(x_p - x_q)^T P^{-1}(x_p - x_q)}{2}\right\} \tag{K10}$$

covSEisoU—Squared Exponential covariance function with isotropic distance measure with unit magnitude.

$$k(x_p, x_q) = \exp\left\{\frac{-(x_p - x_q)^T P^{-1}(x_p - x_q)}{2}\right\} \tag{K11}$$

Figure 3:
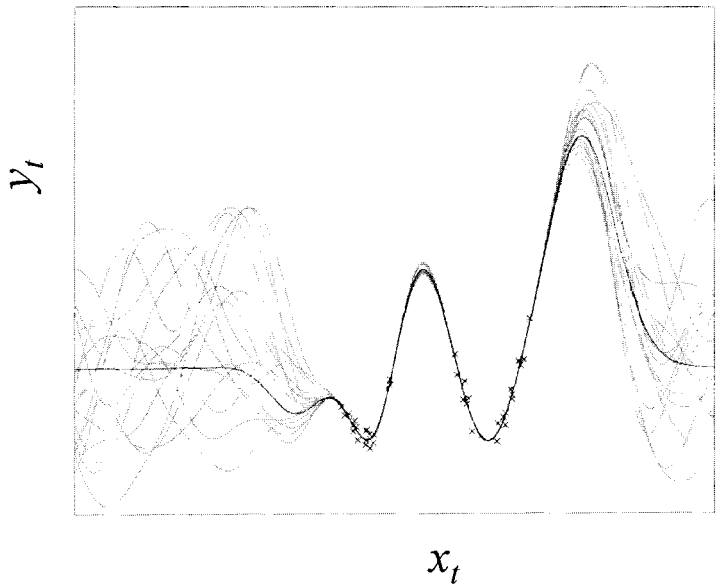
FIG. 3 is a plot of a number of samples drawn from the distribution shown in equation 19.
Figure 4:
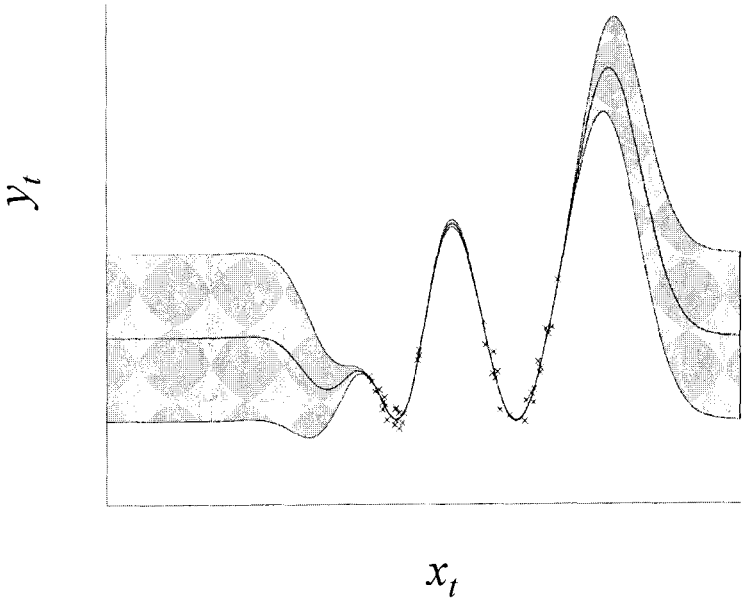
FIG. 4 is a plot showing the mean and associated variance of the data of FIG. 3 at each point.

Using equations 18 and 19 above, leads to a Gaussian process predictive distribution which is shown in FIGS. 3 and 4: FIG. 3 shows a number of samples drawn from the resulting Gaussian process posterior exposing the underlying sinc function through noisy observations. The posterior exhibits large variance where there is no local observed data. FIG. 4 shows the confidence intervals on sampling from the posterior of the GP computed on samples from the same noisy sinc function. The distribution is represented as $$p(y_t|x_t,x^*,y^*,\mathcal{M}) = \mathcal{N}(\mu(x_t),\Sigma(x_t)), \tag{19}$$

where $\mu(x_t)$ and $\Sigma(x_t)$ are the mean and variance of the predictive distribution for given $x_t$. These may be expressed as $$\mu(x_t)=m(x_t)+k_t^T[K^*+\sigma^2 I]^{-1}(y^*-\mu^*) \tag{20}$$

$$\Sigma(x_t)=k(x_t,x_t)+\sigma^2-k_t^T[K^*+\sigma^2 I]^{-1}k_t, \tag{21}$$

Where μ* is the training mean vector and K* and k are Gramian matrices. They are given as $$\mu^* = [m(x_1^*)\ m(x_2^*)\ \ldots\ m(x_N^*)]^T \tag{22}$$

$$K^* = \begin{bmatrix} k(x_1^*, x_1^*) & k(x_1^*, x_2^*) & \ldots & k(x_1^*, x_N^*) \\ k(x_2^*, x_1^*) & k(x_2^*, x_2^*) & \ldots & k(x_2^*, x_N^*) \\ \vdots & \vdots & \ldots & \vdots \\ k(x_N^*, x_1^*) & k(x_N^*, x_2^*) & \ldots & k(x_N^*, x_N^*) \end{bmatrix} \tag{23}$$

$$k_t = [k(x_1^*, x_t)\ k(x_2^*, x_t)\ \ldots\ k(x_N^*, x_t)]^T \tag{24}$$

The above method computes a matrix inversion which is $O(N^3)$ however sparse methods and other reductions like using Cholesky decomposition may be used.

Using the above method it is possible to use GPs to derive a mapping function between source and target speakers.

From Eqs. (20) and (21) the means and covariance matrices for the prediction can be obtained. However if used directly this would again yield a frame-by-frame prediction. To address this the dynamic parameters can also be predicted. Thus, two GP experts can be produced:

static expert: $y_t \sim \mathcal{N}(\mu(x_t), \Sigma(x_t))$ dynamic expert: $\Delta y_t \sim \mathcal{N}(\Delta x_t), \Sigma(\Delta x_t))$ In an embodiment, GPs for each of the static and delta experts are trained independently, though this is not necessary.

If only the static expert is used, then in the same fashion as GMM VC the estimated trajectory is just frame by frame. Thus $$y_t = \mathbb{E}[y_t \mid x_t] \tag{25}$$

$$= \int p(y_t \mid x_t, x^*, y^*, M) y_t d y_t \tag{26}$$

$$= \mu(x_t). \tag{27}$$

In the same fashion as the standard GMM VC process it is possible to use these $$\hat{y} = \arg\max_y \left\{ \prod_{t=1}^{T} N\left(y_t; \mu(x_t), \sum(x_t)\right) N\left(\Delta y_t; \mu(\Delta x_t), \sum(\Delta x_t)\right) \right\} \tag{28}$$

As the GP predictive distributions are Gaussian, a standard speech parameter generation algorithm can be used to generate the smooth trajectories of target static features from the GP experts.

A Gaussian Process is completely described by its covariance and mean functions. These when coupled with a likelihood function are everything that is needed to perform inference. The covariance function of a Gaussian Process can be thought of as a measure that describes the local covariance of a smooth function. Thus a data point with a high covariance function value with another is likely to deviate from its mean in the same direction as the other point. Not all functions are covariance functions as they need to form a positive definite Gram matrix.

There are two kinds of kernel, stationary and non-stationary. A stationary covariance function is a function of $x_t - x_j$. Thus it is invariant stationery to translations in the input space. Non-stationery kernels take into account translation and rotation. Thus isotropic kernel are atemporal when looking at time series as they will yield the same value wherever they are evaluated if their input vectors are the same distance apart. This contrast with non-stationary kernels that will give difference values. An example of an isotropic kernel is the squared exponential $$k(x_p, x_q) = \exp\left\{-\frac{1}{2}(x_p - x_q)^2\right\}, \tag{29}$$

which is a function of the distance between its input vectors. An example of a non-stationary kernel is the linear kernel.

$$k(x_p, x_q) = x_p \cdot x_q, \tag{30}$$

Both types can be of use in voice conversion. Firstly under stationary assumptions iso-tropic kernels can capture the local behaviour of a spectrum well. Non-stationary kernels handle time series better when there is little correlation. The kernels described above are parameter free. It is also possible to have covariance functions that have hyperparameters that can be trained. One example is a linear covariance function with automatic relevance detection (ARD) where:

$$k(x_p, x_q) = x_p * (P^{-1}) * x_q \tag{31}$$

$P^{-1}$ is a free parameter that needs to be trained. For a complete list of the forms of covariance function examined in this work see Appendix A. A combination of kernels can also be used to describe speech signals. There are also a few choices for the mean function of a Gaussian Process; a zero mean, m(x)=0, a constant mean μ(x)=μ, a linear mean m(x)=ax, or their combination m(x)=ax+μ. In this embodiment, the combination of constant and linear mean, m(x)=ax+μ, was used for all systems.

Covariance and mean functions have parameters and selecting good values for these parameters has an impact on the performance of the predictor. These hyper-parameters can be set a priori but it makes sense to set them to the values that best describe the data; maximize the negative marginal log likelihood of the data. In an embodiment, the hyper-parameters are optimized using Polack-Ribiere conjugate gradients to compute the search directions, and a line search using quadratic and cubic polynomial approximations and the Wolfe-Powell stopping criteria was used together with the slope ratio method for guessing initial step sizes.

The size of the Gramian matrix K, which is equal to the number of samples in the training data, can be tens of thousands in VC. Computing the inverse of the Gramian matrix requires $O(N^3)$. In an embodiment, the input space is first divided into its sub-spaces then a GP is trained for each sub-space. This reduces the number of samples that are trained for each GP. This circumvents the issue of slow matrix inversion and also allows a more accurate training procedure that improves the accuracy of the mapping on a per-cluster level. The Linde-Buza-Gray (LBG) algorithm with the Euclidean distance in mel-cepstral coefficients is used to split the data into its sub-spaces.

A voice conversion method in accordance with an embodiment of the present invention will now be described with reference to FIG. 5.

Figure 5:
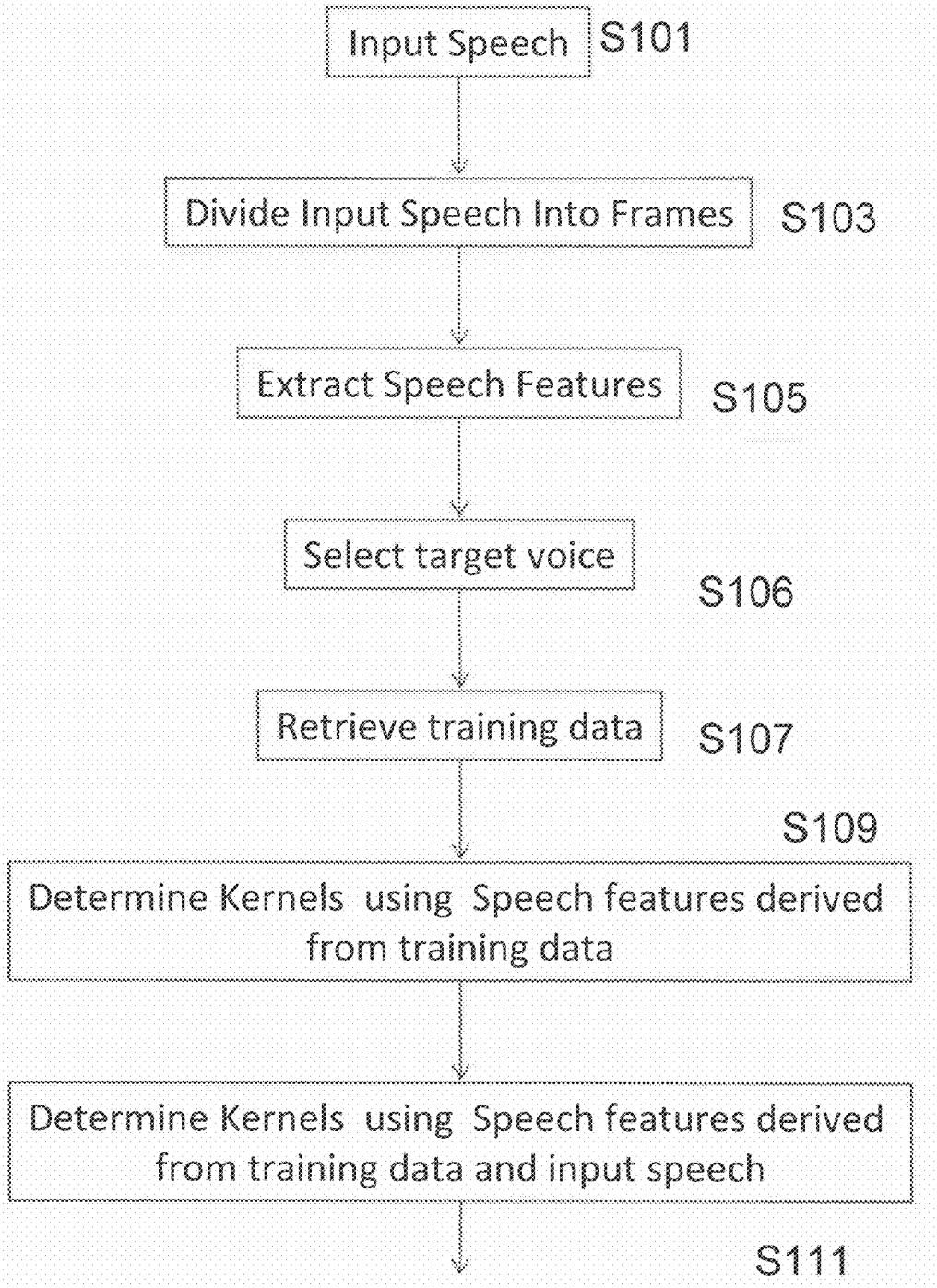
FIG. 5 is a flow diagram showing a method in accordance with the present invention.

FIG. 5 is a schematic of a flow diagram showing a method in accordance with an embodiment of the present invention using the Gaussian Processes which have just been described. Speech is input in step S101. The input speech is digitised and split into frames of equal lengths. The speech signals are then subjected to a spectral analysis to determine various features which are plotted in an "acoustic space".

The front end unit also removes signals which are not believed to be speech signals and other irrelevant information. Popular front end units comprise apparatus which use filter bank (F BANK) parameters, Melfrequency Cepstral Coefficients (MFCC) and Perceptual Linear Predictive (PLP) parameters. The output of the front end unit is in the form of an input vector which is in n-dimensional acoustic space.

Figure 7:
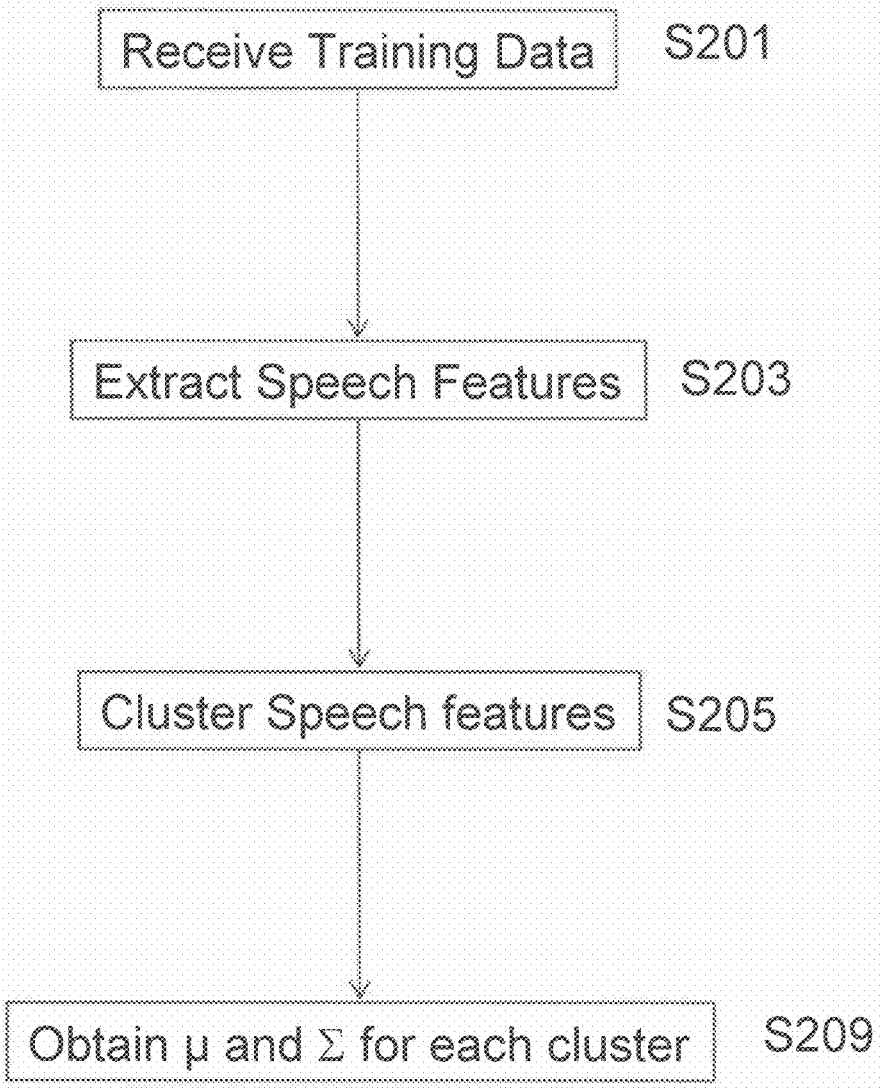
FIG. 7 is a flow diagram showing the training stages of a method in accordance with an embodiment of the present invention.

The speech features are extracted in step S105. In some systems, it may be possible to select between multiple target voices. If this is the case, a target voice will be selected in step S106. The training data which will be described with reference to FIG. 7 is then retrieved in step S107.

Figure 8:
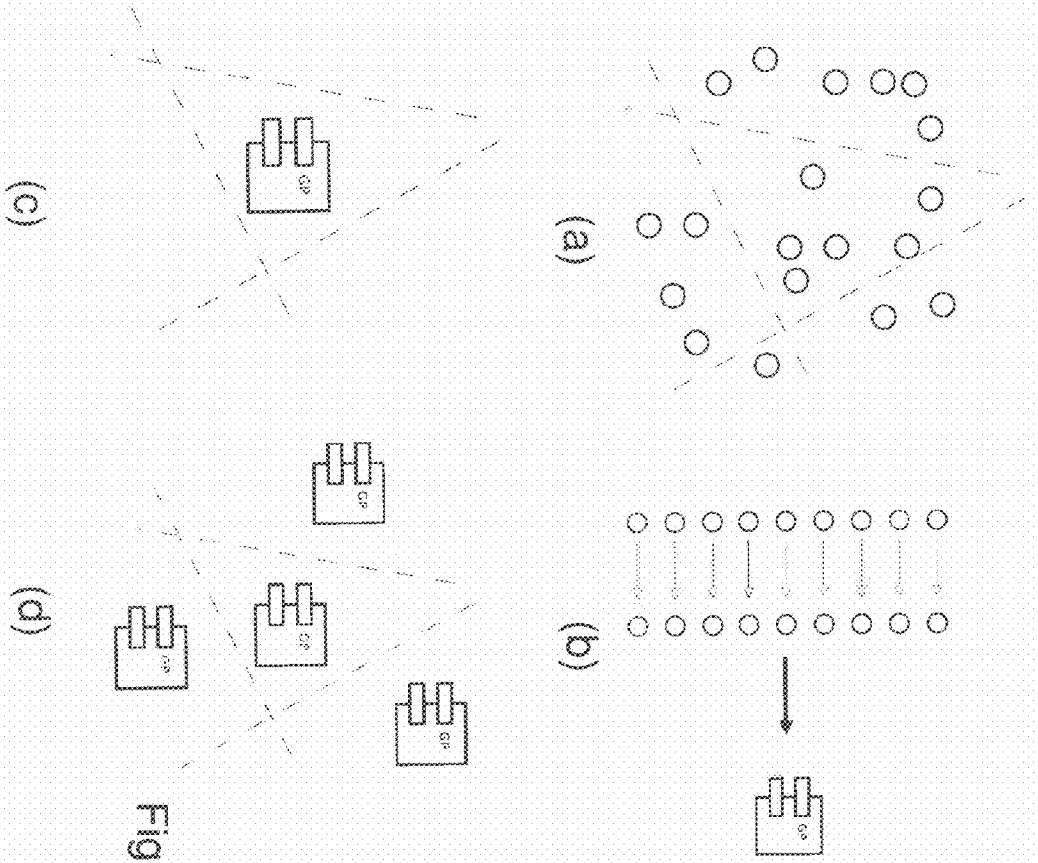
FIGS. 8 (*a*) to 8(*d*) is a schematic illustrating clustering which may be used in a method in accordance with the present invention.

Next, kernels are derived which defines the similarity between two speech vectors. In step S109, kernels are derived which show the similarity between different speech vectors in the training data. In order to reduce the computing complexity, in an embodiment, the training data will be partitioned as described with reference to FIGS. 7 and 8. The following explanation will not use clustering, then an example will be described using clustering.

Next, kernels are derived looking this time at the similarity between speech features derived from the training data and the actual input speech.

Figure 6:
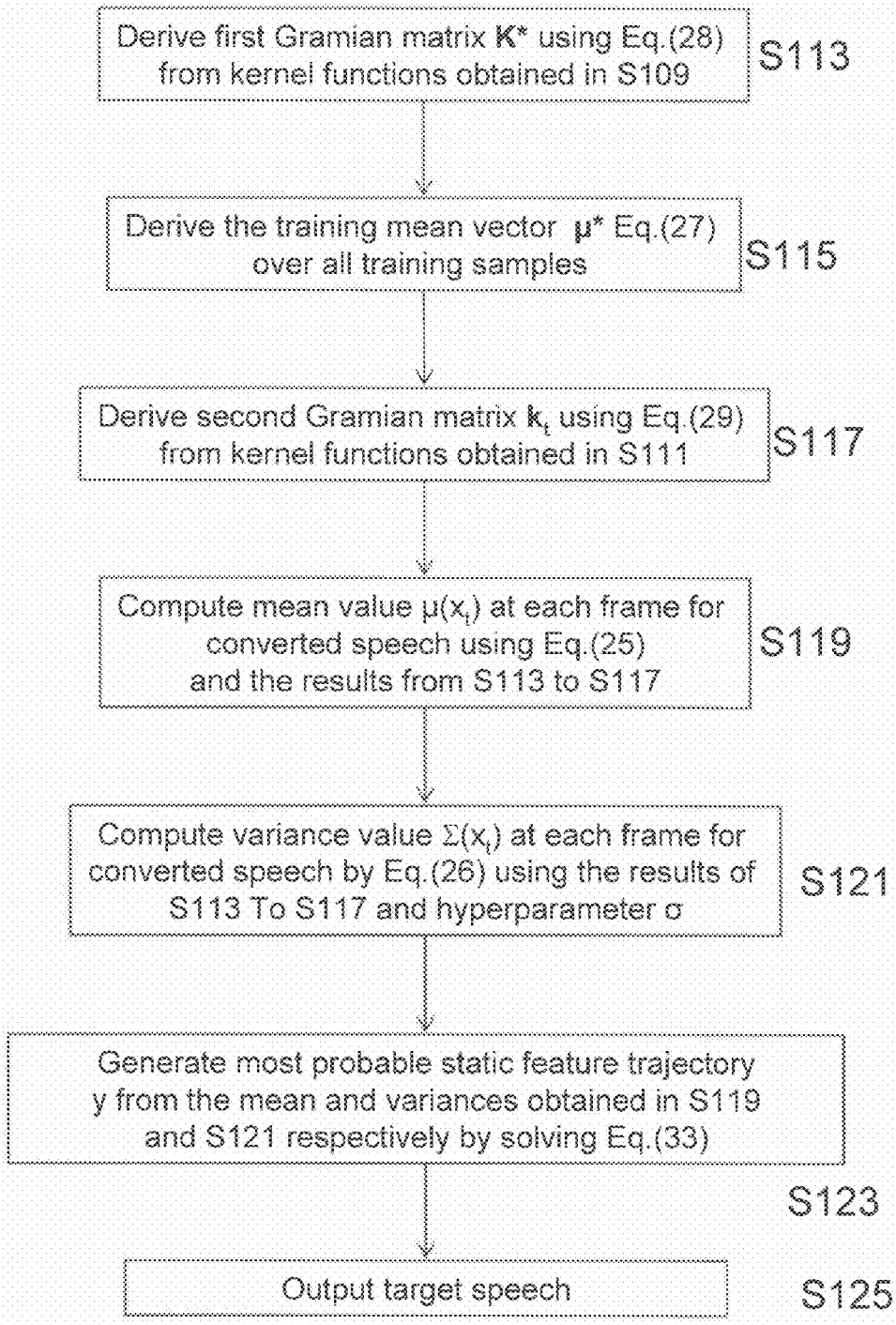
FIG. 6 is a flow diagram continuing from FIG. 5 showing a method in accordance with an embodiment of the present invention.

The method then continues at step S113 of FIG. 6. Here, the first Gramian matrix is derived using equation 23 from the kernel functions obtained in step S109. The Gramian matrix K* can be derived during operation or may be computed offline since it is derived purely from training data.

The training mean vector p* is then derived using equation 22 and this is the mean taken over all training samples in this embodiment.

A second Gramian matrix $k_t$ is derived using equation 24 this uses the kernel functions obtained in step S111 which looks at the similarity between training data and input speech.

Then using the results of step S113, S115 and S117, the mean value at each frame is computed for the target speech using equation 25.

The variant value is then computed for each frame of the converted speech. The converted speech is the most likely approximation to the target speech. Using the results derived in S113, S115 and S117. The covariant function has hyper-parameter σ. Hyper-parameter σ can be optimized as previously described using techniques such as Polack-Ribiere conjugate gradients to compute the search directions and a line search using quadratic and cubic polynomial approximations and the Wolfe-Powell stopping criteria was used together with the slope ratio method for guessing initial step sizes.

Using the results of step S119 and step S121, the most probable static feature y (target speech) from the mean and variances is generated by solving equation 28. The target speech is then output in step S125.

FIG. 7 shows a flow diagram on how the training data is handled. The training data can be pre-programmed into the system so that all manipulations using purely the training data can be computed offline or training data can be gathered before voice conversion takes place. For example, a user could be asked to read known text just prior to voice conversion taking place. When the training data is received in step S201, it is processed it is digitised and split it into frames of equal lengths. The speech signals are then subjected to a spectral analysis to determine various parameters which are plotted in an "acoustic space" or feature space. In this embodiment, static, delta and delta delta, features are extracted in step S203. Although, in some embodiments, only static features will be extracted.

Signals which are believed not to be speech signals and other irrelevant information are removed.

In this embodiment, the speech features are clustered S205 as shown in FIG. 8*a* The acoustic space is then partitioned on the basis of these clusters. Clustering will produce smaller Gramians in equations 23 and 24 which will allow them to be more easily manipulated. Also, by partitioning the input space, the hyper-parameters can be trained over the smaller amount of data for each cluster as opposed to over the whole acoustic space.

For each cluster, the hyper-parameters are trained for each cluster in step S207 and FIG. 8*b*. $\mu_m$ and Σ are obtained for each cluster in step S209 and stored as shown in FIG. 8*c*. Gramian Matrix. K* is also stored.

The procedure is then repeated for each cluster.

In an embodiment where clustering has been performed, in use, an input speech vector which is extracted from the speech which is to be converted is assigned to a cluster. The assignment takes place by seeing in which cluster in acoustic space the input vector lies. The vectors μ(xt) and Σ(xt) are then determined using the data stored for that cluster.

In a further embodiment, soft clusters are used for training the hyper-parameters. Here, the volume of the cluster which is used to train the hyper-parameters for a part of acoustic space is taken over a region over acoustic space which is larger than the said part. This allows the clusters to overlap at their edges and mitigates discontinuities at cluster boundaries. However, in this embodiment although the clusters extend over a volume larger than the part of acoustic space defined when acoustic space is partitioned in step S205, assignment of an speech vector to be converted will be on the basis of the partitions derived in step S205.

Voice conversion systems which incorporate a method in accordance with the above described embodiment, are, in general more resistant to overfitting and oversmoothing. It also provides an accurate prediction of the format structure. Over-smoothing exhibits itself when there is not enough flexibility in a modelling of the relationship between the target speaker and input speaker to capture certain structure in the spectral features of the target speaker. The most detrimental manifestation of this is the over-smoothing of the target spectra. When parametric methods are used to model the relationship between the target speaker and input speaker, it is possible to add more parameters. However, adding more mixture components allows for more flexibility in the set of mean parameters and can tackle these problems of over-smoothing but soon encounters over-fitting in the data and quality is lost especially in an objective measure like melcepstral distortion. Also parametric models have more limited ability as more data is introduced as they lose flexibility and also the meaning of the parameters can become difficult to interpret.

The above described embodiment applies a Gaussian process (GP) to Voice Conversion. Gaussian processes are non-parametric Bayesian models that can be thought of as a distribution over functions. They provide advantages over the conventional parametric approaches, such as flexibility due to their non-parametric nature.

Further, such a Gaussian Process based approach is resistant to over-fitting.

As such an approach is non-parametric it tackles the issue of the meaning of parameters used in a parametric approach. Also, being non-parametric means that there are only a few hyper-parameters that need to be trained and these parameters maintain their meaning even when more data is introduced. These advantages help to circumvent issues with scaling.

Figure 9:
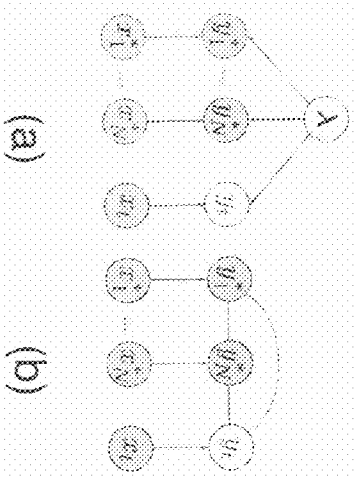
FIG. 9 (*a*) is a schematic showing a parametric approach for voice conversion and FIG. 9(*b*) is a schematic showing a method in accordance with an embodiment of the present invention.

FIGS. 9*a* and 9*b* show schematically how the above Gaussian Process based approach differs from parametric approaches. Here, following the previous notation, it is desired to convert speech vectors $x_t$ from the first voice to speech vectors $y_t$ of the second voice. In the previous parametric based approaches, set of model parameters λ are derived based on speech vectors of the first voice x1*, . . . , xN* and the second voice y1*, . . . , yN*. The parameters are derived by looking at the correspondence between the speech vectors of the training data for the first voice with the corresponding speech vectors of the training data of the second voice. Once the parameters are derived, they are used to derive the mapping function from the input vector from the first voice xt to the second voice yt. In this stage, only the derived parameters λ is used as shown in FIG. 9*a*.

However, in embodiments according to the present invention, model parameters are not derived and the mapping function is derived by looking at the distribution across all training vectors either across the whole acoustic space or within a cluster if the acoustic space has been partitioned.

To evaluate the performance of the Gaussian Process based approach, a speaker conversion experiment was conducted. Fifty sentences uttered by female speakers, CLB and SLT, from the CMU ARCTIC database were used for training (source: CLB, target: SLT). Fifty sentences, which were not included in the training data, were used for evaluation. Speech signals were sampled at a rate of 16 kHz and windowed with 5 ms of shift, and then 40th-order mel-cepstral coefficients were obtained by using a mel-cepstral analysis technique. The log F0 values for each utterance were also extracted. The feature vectors of source and target speech consisted of 41 mel-cepstral coefficients including the zeroth coefficients. The DTW algorithm was used to obtain time alignments between source and target feature vector sequences. According to the DTW results, joint feature vectors were composed for training joint probability density between source and target features. The total number of training samples was 34,664.

Five systems were compared in this experiment, which were

GMMs without dynamic features as shown in FIG. 10*a*

GMMs with dynamic features as shown in FIG. 10*b;* trajectory GMMs as shown in FIG. 10*c;*

GPs without dynamic features as shown in FIG. 10*d*

GPs with dynamic features as shown in FIG. 10*e*.

They were trained from the composed joint feature vectors. The dynamic features (delta and delta-delta features) were calculated as $$\Delta x_t = 0.5x_{t+1} - 0.5x_{t-1},$$

$$\Delta x_t = x_{t+1} - 2x_{t-1}.$$

For GP-based VC, we split the input space (mel-cepstral coefficients from the source speaker) into 32 regions using the LBG algorithm then trained a GP for each cluster for each dimension. According to the results of a preliminary experiment, we chose combination of constant and linear functions for the mean function of GP-based VC.

The log F0 values in this experiment were converted by using the simple linear conversion. The speech waveform was re-synthesized from the converted mel-cepstral coefficients and log F0 values through the mel log spectrum approximation (MLSA) filter with pulse-train or white-noise excitation.

The accuracy of the method in accordance with an embodiment was measured for various kernel functions. The mel-cepstral distortion between the target and converted mel-cepstral coefficients in the evaluation set was used as an objective evaluation measure.

First, the choice of kernel functions (covariance function), the effect of optimizing hyper-parameters, and the effect of dynamic features was evaluated. Tables 1 and 2 show the melcepstral distortions between target speech and converted speech by the proposed GP-based mapping with various kernel functions, with and without using dynamic features, respectively.

It can be seen from Table 1 that optimizing the hyper-parameter slightly reduced the distortions and the isotropic kernels appeared to outperform the non-stationary ones. This is believed to be due to the consistency between evaluation measure and kernel function. The mel-cepstral distortion is actually the total Euclidean distance between two mel-cepstral coefficients in dB scale. The linear kernel uses the distance metric in input space (mel-cepstral coefficients), thus the evaluation measure (mel-cepstral distortion) and similarity measure (kernel function) was consistent. Table 2 indicates that the use of dynamic features degraded the mapping quality.

Next the GP-based conversion in accordance with an embodiment of the invention is compared with the conventional approaches. Table 3 shows the mel-cepstral distortions by conversion approaches by GMM with and without dynamic features, trajectory GMMs, and the proposed GP based approaches. It can be seen from the table that the proposed GP-based approaches achieved significant improvements over the conventional parametric approaches.

Figure 10:
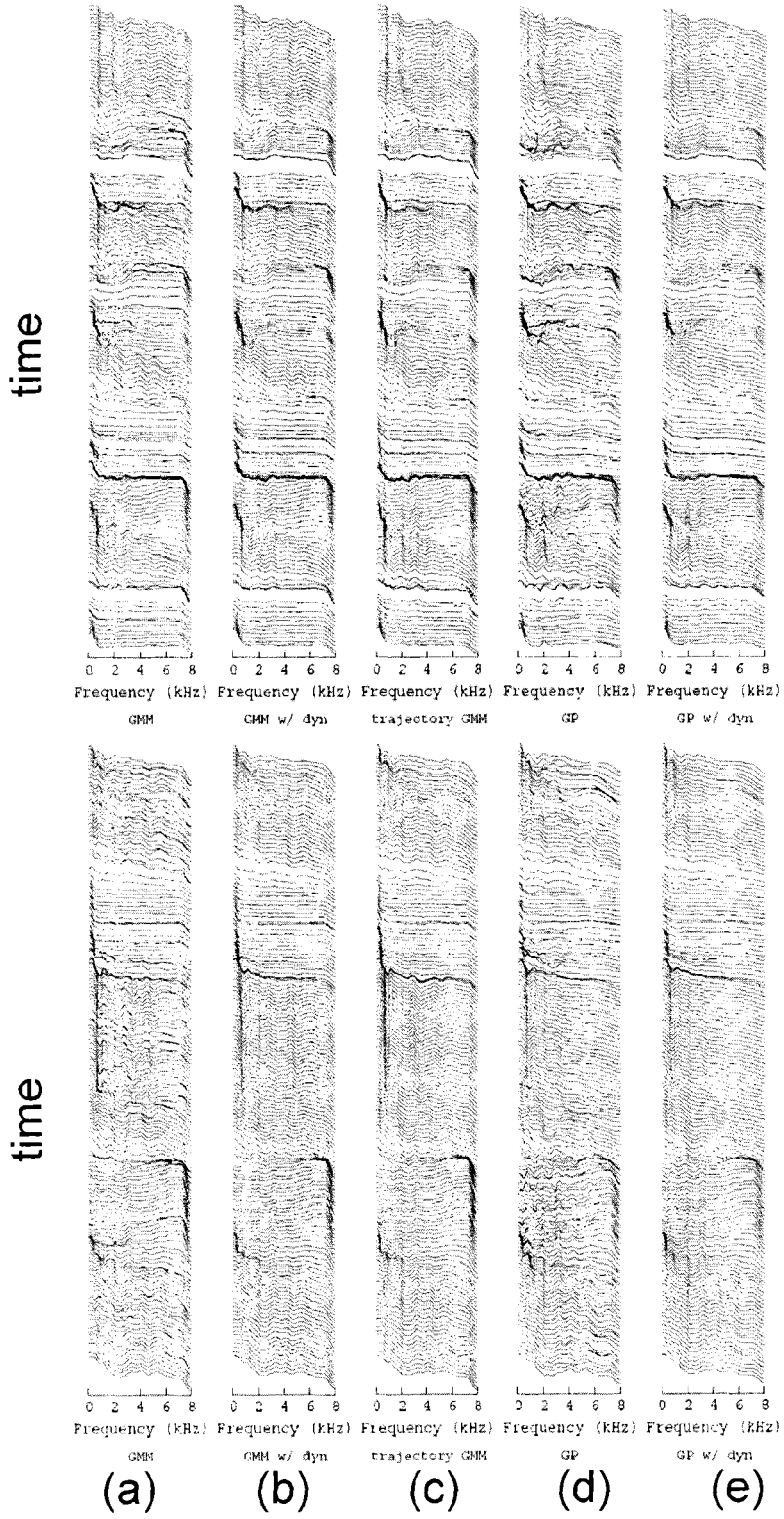
FIG. 10 shows a plot of running spectra of converted speech for a static parametric based approach (FIG. 10*a*), a dynamic parametric based approach (FIG. 10*b*), a trajectory parametric based approach, which uses a parametric model including explicit dynamic feature constraints (FIG. 10*c*), a Gaussian Process based approach using static speech features in accordance with an embodiment of the present invention (FIG. 10*d*) and a Gaussian Process based approach using dynamic speech features in accordance with an embodiment of the present invention (FIG. 10*e*).

It can be seen from the results of FIG. 10 that the GMM is excessively smoother compared to the GP approach without dynamic features. It is known that the statistical modeling process often removes details of spectral structure. The GP-based approach has not suffered from this problem and maintains the fine structure of the speech spectra.

TABLE 1

Mel-cepstral distortions between target speech and converted speech by GP models (without dynamic features) using various kernel function with and without optimizing hyperparameters.

| Covariance | Distortion [dB] | |
|---|---|---|
| Functions | w/o optimization | w/ optimization |
| covLIN | 3.97 | 3.96 |
| covLINard | 3.97 | 3.95 |
| covLINone | 4.94 | 4.94 |
| covMaterniso | 4.98 | 4.96 |
| covNNone | 4.95 | 4.96 |
| covPoly | 4.97 | 4.95 |
| covPPiso | 4.99 | 4.96 |
| covRQard | 4.97 | 4.96 |
| covRQiso | 4.97 | 4.96 |
| covSEard | 4.96 | 4.95 |
| covSEiso | 4.96 | 4.95 |
| covSEisoU | 4.96 | 4.95 |

TABLE 2

Mel-cepstral distortions between target speech and converted speech by GP models using various kernel functions with and without dynamic features. Note that hyper-parameters were optimized.

| Covariance | Distortion [dB] | |
|---|---|---|
| Functions | w/o dyn. feats. | w/ dyn. feats. |
| covLIN | 3.96 | 4.15 |
| covLINard | 3.95 | 4.15 |
| covLINone | 4.94 | 5.92 |
| covMaterniso | 4.96 | 5.99 |
| covNNone | 4.96 | 5.95 |
| covPoly | 4.95 | 5.80 |
| covPPiso | 4.96 | 6.00 |
| covRQard | 4.96 | 5.98 |

TABLE 2-continued

Mel-cepstral distortions between target speech and converted speech by GP models using various kernel functions with and without dynamic features. Note that hyper-parameters were optimized.

| Covariance Functions | Distortion [dB] w/o dyn. feats. | Distortion [dB] w/ dyn. feats. |
|---|---|---|
| covRQiso | 4.96 | 5.98 |
| covSEard | 4.95 | 5.98 |
| covSEiso | 4.95 | 5.98 |
| covSEisoU | 4.95 | 5.98 |

TABLE 3

Mel-cepstral distortions between target speech and converted speech by GMM, trajectory GMM, and GP-based approaches. Note that the kernel function for GP-based approaches was covLINard and its hyper-parameters were optimized.

| # of Mixs. | GMM w/o dyn. | GMM w/ dyn. | Traj. GMM | GP w/o dyn. | GP w/ dyn. |
|---|---|---|---|---|---|
| 2 | 5.97 | 5.95 | 5.90 | | |
| 4 | 5.75 | 5.82 | 5.81 | | |
| 8 | 5.66 | 5.69 | 5.63 | | |
| 16 | 5.56 | 5.59 | 5.52 | | |
| 32 | 5.49 | 5.53 | 5.45 | 3.95 | 4.15 |
| 64 | 5.43 | 5.45 | 5.38 | | |
| 128 | 5.40 | 5.38 | 5.33 | | |
| 256 | 5.39 | 5.35 | 5.35 | | |
| 512 | 5.41 | 5.33 | 5.42 | | |
| 1024 | 5.50 | 5.34 | 5.64 | | |

The above experimental results shown here indicated that GP with the simple linear kernel function achieved the lowest melcepstral distortion among many kernel functions. It is believed that this is due to the consistency between evaluation measure and kernel function. The mel-cepstral distortion used here is actually the total Euclidean distance between two mel-cepstral coefficients. The linear kernel uses the distance metric in input space (mel-cepstral coefficients), thus the evaluation measure (mel-cepstral distortion) and similarity measure (kernel function) was consistent.

However, it is known that the mel-cepstral distortion is not highly correlated to human perception.

Therefore, in a further embodiment, the kernel function is replaced by a distance metric more correlated to human perception.

One possible metric is the log-spectral distortion (LSD), where the distance between two power spectra $P(\omega)$ and $\hat{P}(\omega)$ is computed as $$D_{LS} = \sqrt{\frac{1}{2\pi}\int_{-\pi}^{\pi}\left[10\log_{10}\frac{P(\omega)}{\hat{P}(\omega)}\right]^2 d\omega} \tag{32}$$

where these two spectra can be computed from the mel-cepstral coefficients using a recursive formulae. An alternative is the Itakura-Saito distance which measures the perceived difference between two spectra. It was proposed by Fumitada Itakura and Shuzo Saito in the 1970s and is defined as $$D_{IS}\left(P(\omega), \hat{P}(\omega)\right) = \frac{1}{2\pi}\int_{-\pi}^{\pi}\left[\frac{P(\omega)}{\hat{P}(\omega)} - \log\frac{P(\omega)}{\hat{P}(\omega)} - 1\right] d\omega. \tag{33}$$

The current implementation operates on scalar inputs, but could be extended to vector inputs.

In a further embodiment, linear combination of iso-tropic and non-stationary kernels are used, for example combinations of those listed as K1 to K10 above.

In the above embodiments, Gaussian Process based voice conversion is applied to convert the speaker characteristics in natural speech. However, it can also be used to convert synthesised speech for example the output for an in-car Sat Nav system or a speech to speech translation system.

In a further embodiment, the input speech is not produced by vocal excitations. For example, the input speech could be bodyconducted speech, esophageal speech etc. This type of system could be of benefit where a user had received a larygotomy and was relying on non-larynx based speech. The system could modify the non-larynx based speech to reproduce the original speech of the user before the laryngotomy. Thus allowing a used to regain a voice which is close to their original voice.

Voice conversion has many uses, for example modifying a source voice to a selected voice in systems such as in-car navigation systems, uses in games software and also for medical applications to allow a speaker who has undergone surgery or otherwise has their voice compromised to regain their original voice.

While certain embodiments have been described, these embodiments have been presented by way of example only, and are not intended to limit the scope of the inventions. Indeed, the novel systems and methods described herein may be embodied in a variety of other forms; furthermore, various omissions, substitutions and changes in the form of the systems and methods described herein may be made without departing from the spirit of the inventions. The accompanying claims and their equivalents are intended to cover such forms or modifications as would fall within the scope and spirit of the inventions.

The invention claimed is:

1. A method of converting speech from the characteristics of a first voice to the characteristics of a second voice, the method comprising:

receiving a speech input from a first voice, dividing said speech input into a plurality of frames;

in a processor, mapping the speech from the first voice to a second voice using a Gaussian process; and outputting the speech in the second voice, wherein mapping the speech from the first voice to the second voice comprises, deriving kernels demonstrating the similarity between speech features derived from the frames of the speech input from the first voice and stored frames of training data for said first voice, the training data corresponding to different text to that of the speech input and wherein the mapping step uses a plurality of kernels derived for each frame of input speech with a plurality of stored frames of training data of the first voice and using said plurality of kernels to define a non-parametric Gaussian process prior for said mapping.

2. A method according to claim 1, wherein kernels are derived for both static and dynamic speech features.

3. A method according to claim 1, wherein the speech to be output is determined according to a Gaussian Process predictive distribution:

$$p(y_t|x_t,x^*,y^*,\mathcal{M})=\mathcal{N}(\mu(x_t),\Sigma(x_t)),$$

where $y_t$ is the speech vector for frame t to be output, $x_t$ is the speech vector for the input speech for frame t, x*, y* is $\{x_1^*, y_1^*\}, \ldots, \{x_N^*, y_N^*\}$, where $x_t^*$ is the t-th frame of training data for the first voice and $y_t^*$ is the t-th frame of training data for the second voice, M denotes the model, $\mu(x_t)$ and $\Sigma(x_t)$ are the mean and variance of the predictive distribution for given $x_t$.

4. A method according to claim 3, wherein $$\mu(x_t) = m(x_t) + k_t^T[K^* + \sigma^2 I]^{-1}(y^* - \mu^*),$$

$$\sum(x_t) = k(x_t, x_t) + \sigma^2 - k_t^T\{K^* + \sigma^2 I]^{-1}k_t,$$

where $$\mu^* = [m(x_1^*)\ m(x_2^*)\ \ldots\ m(x_N^*)]^T$$

$$K^* = \begin{bmatrix} k(x_1^*, x_1^*) & k(x_1^*, x_2^*) & \ldots & k(x_1^*, x_N^*) \\ k(x_2^*, x_1^*) & k(x_2^*, x_2^*) & \ldots & k(x_2^*, x_N^*) \\ \vdots & \vdots & \ldots & \vdots \\ k(x_N^*, x_1^*) & k(x_N^*, x_2^*) & \ldots & k(x_N^*, x_N^*) \end{bmatrix}$$

$$k_t = [k(x_1^*, x_t)\ k(x_2^*, x_t)\ \ldots\ k(x_N^*, x_t)]^T$$

and σ is a parameter to be trained, $m(x_t)$ is a mean function and $k(x_t, x_t')$ is a kernel function representing the similarity between $x_t$ and $x_t'$.

5. A method according to claim 4, wherein the kernel function is isotropic.

6. A method according to claim 4, wherein the kernel function is parameter free.

7. A method according to claim 4, wherein the mean function is of the form:

$$m(x_t)=ax_t+b.$$

8. A method according to claim 3, further comprising receiving training data for a first voice and a second voice.

9. A method according to claim 8, further comprising training hyper-parameters from the training data.

10. A method according to claim 1, wherein the speech features are represented by vectors in an acoustic space and said acoustic space is partitioned for the training data such that a cluster of training data represents each part of the partitioned acoustic space, wherein during mapping, a frame of input speech is compared with the stored frames of training data for the first voice which have been assigned to the same cluster as the frame of input speech.

11. A method according to claim 10, wherein two types of clusters are used, hard clusters and soft clusters, wherein in said hard clusters the boundary between adjacent clusters is hard so that there is no overlap between clusters and said soft clusters extend beyond the boundary of the hard clusters so that there is overlap between adjacent soft clusters, said frame of input speech being assigned to a cluster on the basis of the hard clusters.

12. A method according to claim 11, wherein the frame of input speech which has been assigned to a cluster on the basis of hard clusters, is then compared with data from the extended soft cluster.

13. A method according to claim 1, wherein the first voice is a synthetic voice.

14. A method according to claim 1, wherein the first voice comprises non-larynx excitations.

15. A non-transitory carrier medium carrying computer readable instructions for controlling the processor to carry out the method of claim 1.

16. A system for converting speech from the characteristics of a first voice to the characteristics of a second voice, the system comprising:

a receiver for receiving a speech input from a first voice;

a processor configured to:

divide said speech input into a plurality of frames; and map the speech from the first voice to a second voice using a Gaussian process, the system further comprising an output to output the speech in the second voice, wherein to map the speech from the first voice to the second voice, the processor is further adapted to derive kernels demonstrating the similarity between speech features derived from the frames of the speech input from the first voice and stored frames of training data for said first voice, the training data corresponding to different text to that of the speech input, the processor using a plurality of kernels derived for each frame of input speech with a plurality of stored frames of training data of the first voice and using said plurality of kernels to define a non-parametric Gaussian process prior for said mapping.

* * * * *